US006648593B2

(12) United States Patent
Motherwell et al.

(10) Patent No.: US 6,648,593 B2
(45) Date of Patent: Nov. 18, 2003

(54) TIP TREATMENT BARS FOR GAS TURBINE ENGINES

(75) Inventors: Andrew Motherwell, Bristol (GB); Brynley Clark, Bristol (GB)

(73) Assignee: Rolls-Royce PLC, London (GB)

( * ) Notice: Subject to any disclaimer, the term of this patent is extended or adjusted under 35 U.S.C. 154(b) by 47 days.

(21) Appl. No.: 10/085,042

(22) Filed: Mar. 1, 2002

(65) Prior Publication Data

US 2002/0122718 A1 Sep. 5, 2002

(30) Foreign Application Priority Data

Mar. 5, 2001 (GB) ..... 0105392

(51) Int. Cl.[7] ..... F01D 25/04
(52) U.S. Cl. ..... 415/119; 415/173.4
(58) Field of Search ..... 415/173.4, 173.5, 415/200, 119, 58.5, 9

(56) References Cited

U.S. PATENT DOCUMENTS 5,474,417 A 12/1995 Privett et al.
6,409,470 B2 * 6/2002 Allford et al. ..... 415/119

FOREIGN PATENT DOCUMENTS

WO WO 94/20759 9/1994

* cited by examiner

*Primary Examiner*—Edward K. Look
*Assistant Examiner*—Kimya N McCoy
(74) *Attorney, Agent, or Firm*—Oliff & Berridge, PLC

(57) ABSTRACT

A tip treatment bar (16) for a gas turbine engine has a damping coating (24) applied to one or more sides. The coating (24) may be a hard ceramic, for example Magnesia Alumina Spinel, and this may be plasma sprayed directly on to the bar (16) or applied to a substrate (26) which may then be applied to the bar (16).

19 Claims, 4 Drawing Sheets

TIP TREATMENT BARS FOR GAS TURBINE ENGINES

FIELD OF THE INVENTION

This invention relates to tip treatment bars of a rotor casing for a gas turbine engine.

BACKGROUND OF THE INVENTION AND PRIOR ART

WO94/20759 discloses an anti-stall tip treatment means in a gas turbine engine, in which an annular cavity is provided adjacent the blade tips of a compressor rotor. The cavity communicates with the gas flow path through the compressor through a series of slots defined between solid tip treatment bars extending across the mouth of the cavity.

Such tip treatments are applicable to both fans and compressors of gas turbine engines, and their purpose is to improve the blade stall characteristics or surge characteristics of the compressor.

Known tip treatment bars are solid and relatively robust and, in general, have poor damping characteristics. Consequently, they are susceptible to high cycle fatigue failure. As the ends of the blades pass the tip treatment bars, the bars are aerodynamically excited. Vibration is induced in the bars in operation of the engine at a frequency determined by the passage of the blades. The vibrating bars deflect in a generally circumferential direction and consequently fatigue failure tends to be initiated by cracking at the slot ends.

It is an object of the present invention to increase the resistance of tip treatment bars to high cycle fatigue stress.

It is a further object of the present invention to reduce the amplitude of lateral vibrations of tip treatment bars.

SUMMARY OF THE INVENTION

According to the present invention there is provided a tip treatment bar for a gas turbine to which bar a coating is applied.

In an embodiment in accordance with the invention, the coating acts to dissipate strain energy generated by deflection of the bar as it vibrates. Consequently the amplitude of the vibrations is reduced, so combating high cycle fatigue failure.

The coating may be a hard ceramic coating, such as Magnesia Alumina Spinel. The coating may be applied directly to the material of the bar, for example by plasma spraying, but alternatively the coating may be applied to a substrate and which is subsequently bonded to the bar.

The tip treatment bars may be made individually and subsequently assembled with end supports to form a tip treatment ring. In another embodiment, a plurality of bars are formed as ring sections by injection moulding and these sections are assembled together to form the ring. Alternatively, the entire ring can be formed by appropriate machining of a single component.

In embodiments in which the hard coating is applied to a substrate, which is bonded onto the tip treatment bar, the substrate may be metal and the coating may be applied to the substrate by plasma spraying. This has the advantage that the coating can be applied to non metallic tip treatment bars, for example those made of composite material, such as an organic matrix composite material, which might not withstand the high temperatures of coating deposition processes such as plasma spraying. The coating may be applied, directly or indirectly, to at least one side of the tip treatment bar.

DETAILED DESCRIPTION OF PREFERRED EMBODIMENTS

Figure 1:
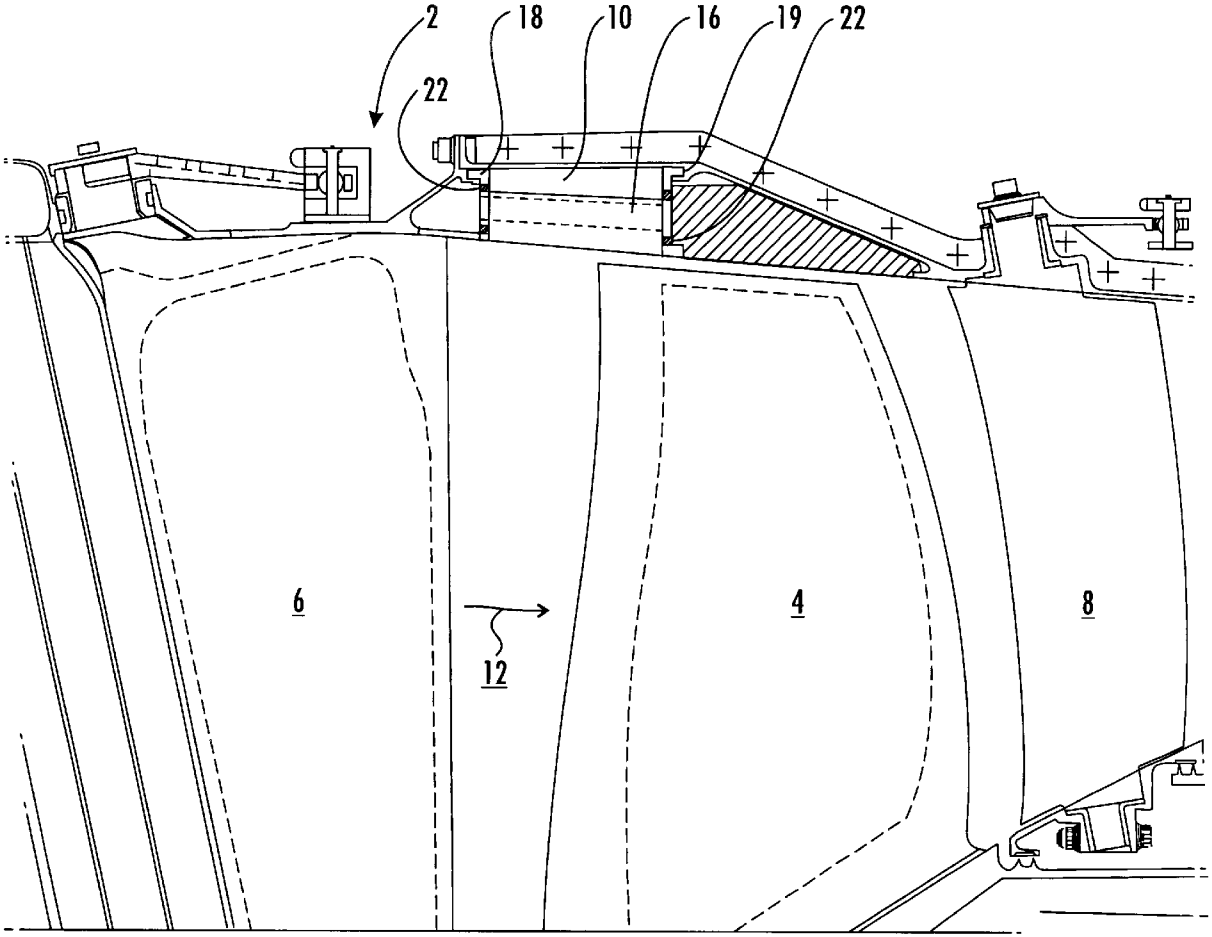
FIG. 1 is a partial axial sectional view of a fan stage in a gas turbine engine.

FIG. 1 represents a fan casing 2 of a gas turbine engine. A fan, represented by a single blade 4, is mounted for rotation in the casing 2. Guide vanes 6 and 8 are provided upstream and downstream, respectively, of the fan 4. The casing 2 includes a circumferentially extending chamber 10, which communicates with the main gas flow through the fan (represented by an arrow 12) through an array of slots 14 (see FIG. 2) defined between tip treatment bars 16 disposed around the casing. The function of the chamber 10 in delaying the onset of stalling of the blades 4 is disclosed in International Patent Publication WO94/20759.

The tip treatment bars 16 are supported by annular front and rear end supports 18, 19 to provide a tip treatment ring 20 which is fitted within the casing 2 and extends around the fan 4. By way of example, the end supports 18, 19 and the bars are made from an organic matrix composite material, such as a carbon fibre/bismaleimide composite.

Figure 2:
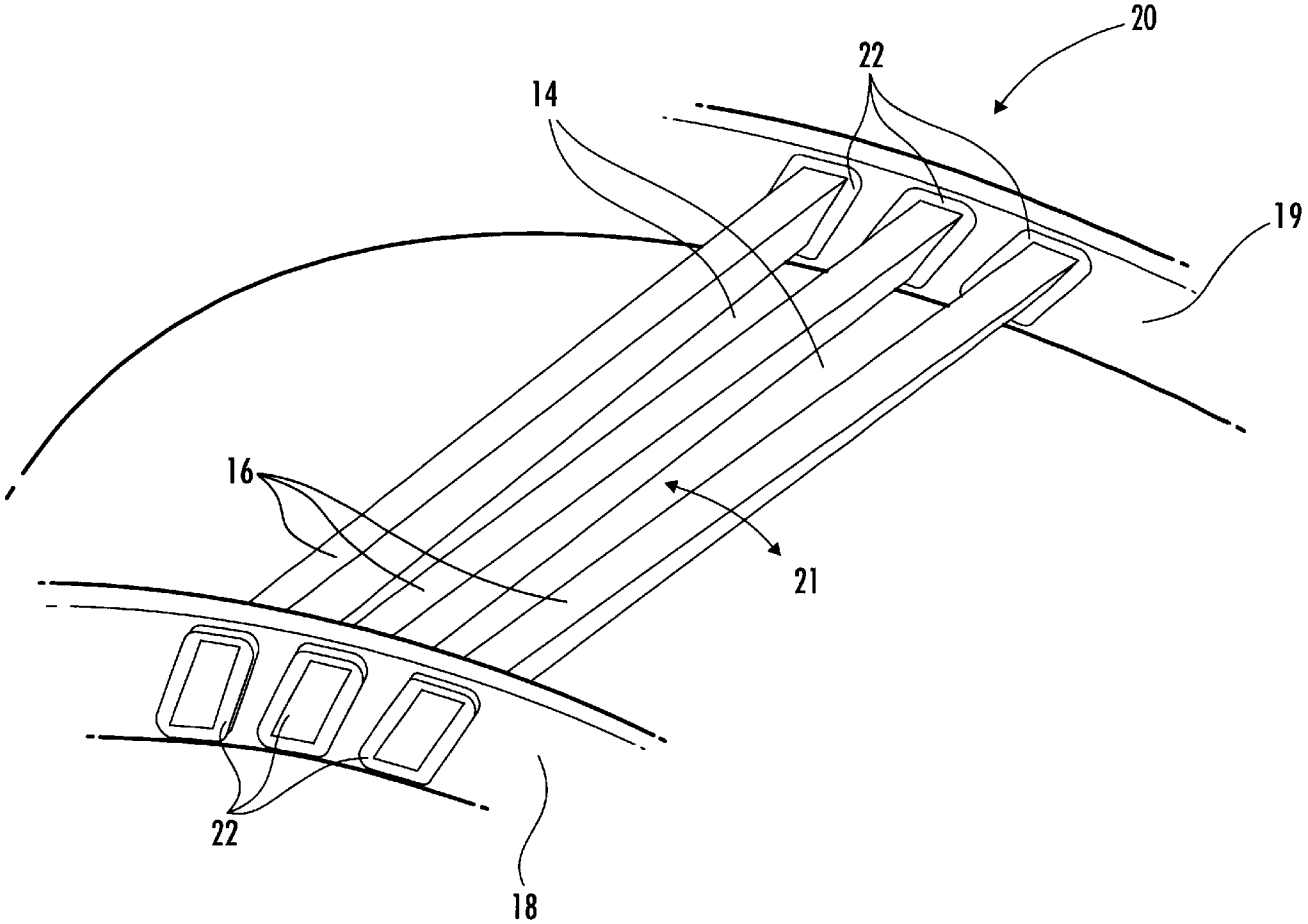
FIG. 2 is a view of tip treatment bars suitable for use in the engine of FIG. 1.

As shown in FIG. 2, the tip treatment bars are provided with damping boots 22 as discussed in greater detail in our British Patent Specification No. 2363167 Alternatively, the boots 22 may be dispensed with so that the bars are connected directly to the end supports 18, 19.

Figure 3:
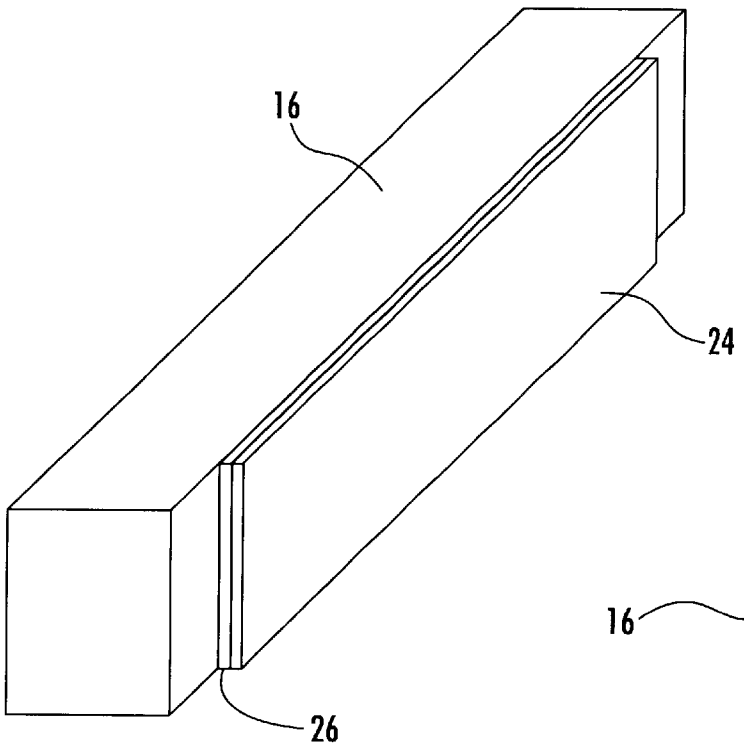
FIG. 3 is a view of a first embodiment of a coated tip treatment bar.

As shown in FIG. 3, the treatment bar 16 is provided with a coating 24. The coating 24 comprises Magnesia Alumina Spinel and is applied by plasma spraying onto a metal substrate 26 before the metal substrate 26 is applied to the bar 16. After the plasma spraying operation is complete, and the substrate 26 has cooled, the substrate 26 is bonded to the bar 16. In the embodiment of FIG. 3, the coating 24 is applied to one side only of the bar 16. In the embodiment illustrated in FIG. 4, two oppositely disposed sides of the bar 16 are each provided with a respective substrate 26 and coating 24. In the assembled ring 20 as shown in FIG. 2, the surface or surfaces to which the coating 24 is applied face generally circumferentially of the ring.

Figure 4:
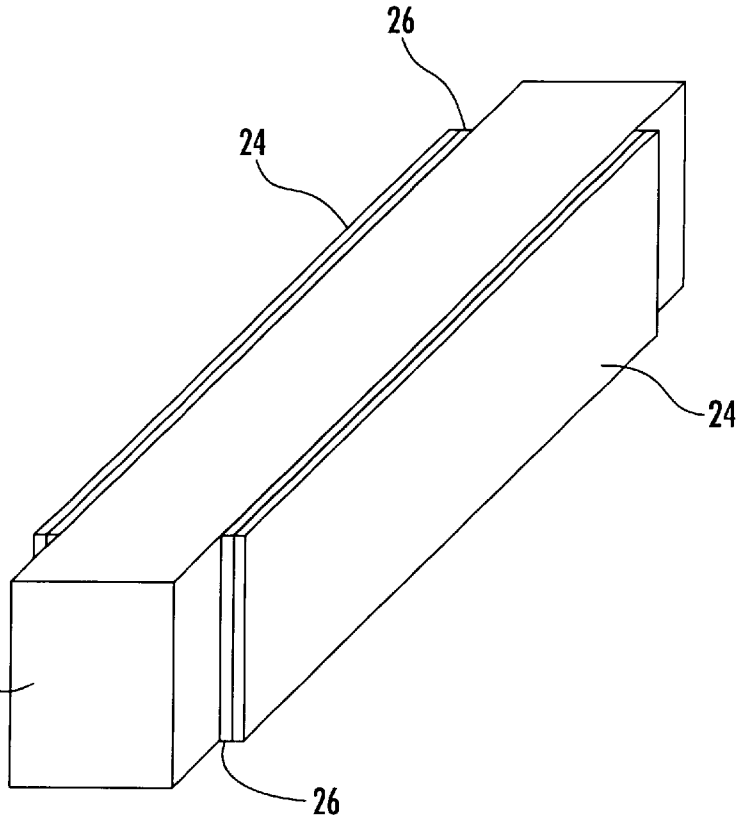
FIG. 4 is a view of a second embodiment of a coated tip treatment bar.

In operation of the engine shown in FIG. 1, equipped with the coated tip treatment bars 16 as described with reference to FIG. 3 or 4, vibration is induced in the bars 16 at a frequency determined by the passage of the blades 4. The vibrating bars 16 deflect in a generally circumferential direction.

The damping characteristic of the hard coating 24 on the tip treatment bars 16 reduces the amplitude of induced vibrations in the tip treatment bars 16. This measure, therefore, reduces the incidence of high cycle fatigue failure in the tip treatment bars 16.

Figure 6:
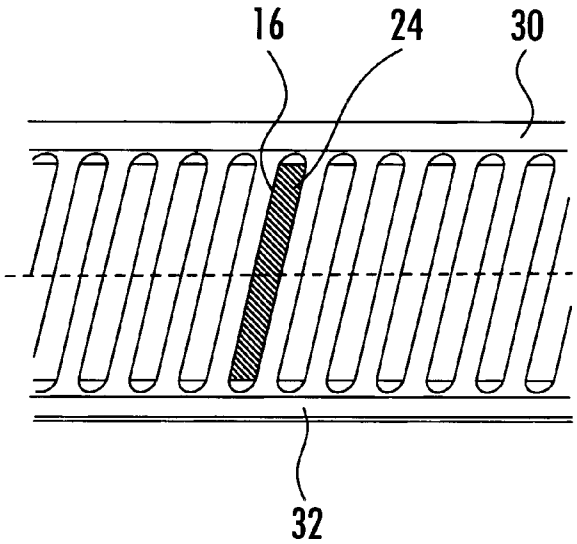
FIG. 6 is a view in the direction of the arrow VI in FIG. 5.
Figure 5:
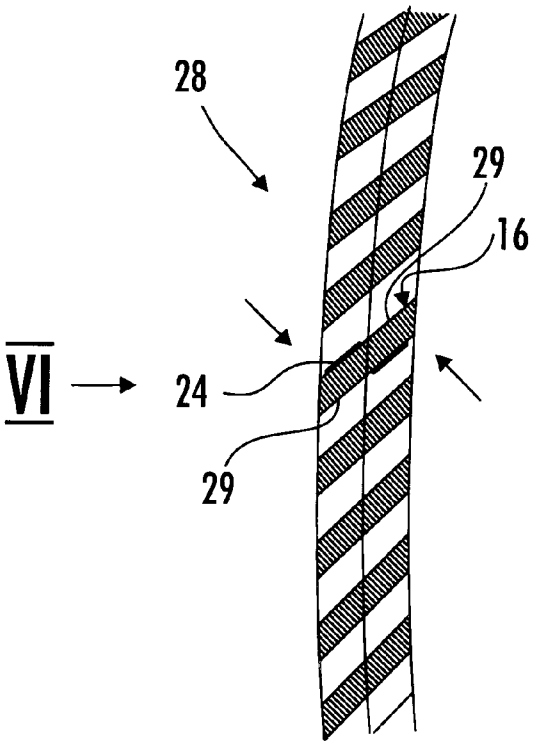
FIG. 5 is a sectional view of a tip treatment ring.

If the material of the tip treatment bar 16 is able to withstand the heat generated in the plasma spraying process, then the coating 24 can be applied directly to the bar 16 without requiring the separate substrate 26. This possibility is illustrated in FIGS. 5 and 6, which show a tip treatment ring 28 which is formed as an integral component from an appropriate alloy.

Since only part of each circumferential surface of each bar 16 is accessible for plasma spraying, in view of the "line of sight" nature of the spraying process, some regions 29 of these surfaces will not receive the coating 24. Nevertheless, the restricted coated area serves, as mentioned above, to reduce the amplitude of vibration so as to minimise high frequency fatigue cracking of the bars 16. If it is desired to apply the coating to the full extent of the circumferential surfaces of the bars 16, the bars 16 can be made and coated separately, as described with reference to FIGS. 3 and 4, although, if the bars 16 are made from alloy, the substrate 26 is not required.

The coatings do not contribute significantly to the impact strength of the tip treatment bar under blade or blade tip release conditions. This is desirable since the blade tip containment philosophy is for blade fragments to penetrate the tip treatment casing and be brought to rest by an external containment system such as a Kevlar wrap.

In the described embodiments, the tip treatment bars are solid. The bars may alternatively have a hollow, thin walled configuration.

We claim:

1. A tip treatment bar for a gas turbine engine, the bar having a coating applied over at least part of at least one face of the bar.

2. A tip treatment bar as claimed in claim 1, in which the coating comprises a hard ceramic coating.

3. A tip treatment bar as claimed in claim 2, wherein the coating is Magnesia Alumina Spinel.

4. A tip treatment bar as claimed in claim 1, wherein the coating is applied to a substrate which is bonded to the bar.

5. A tip treatment bar as claimed in claim 4, wherein the substrate is metal.

6. A tip treatment bar as claimed in claim 4, wherein the substrate is bonded to the bar by a low temperature process.

7. A tip treatment bar as claimed in claim 4, wherein the coating is applied to the substrate by plasma spraying.

8. A tip treatment bar as claimed in claim 1, wherein the coating is applied directly to the material of the bar.

9. A tip treatment bar as claimed in claim 8, wherein the coating is applied to the bar by plasma spraying.

10. A tip treatment bar as claimed in claim 1, wherein the coating is applied to one surface of the bar only.

11. A tip treatment bar as claimed in claim 1, wherein the coating is applied to two oppositely disposed surfaces of the bar.

12. A tip treatment bar as claimed in claim 1, wherein the material of the bar is metal.

13. A tip treatment bar as claimed in claim 1, wherein the material of the bar is a composite material.

14. A tip treatment bar as claimed in claim 13, wherein the material of the bar is an organic matrix composite material.

15. A tip treatment ring comprising oppositely disposed end supports and a plurality of tip treatment bars disposed in an annular array and supported at their ends by end supports, each tip treatment bar having a coating applied over at least part of at least one face of the bar.

16. A tip treatment ring as claimed in claim 15, in which each bar has oppositely disposed surfaces which face generally in the circumferential direction of the ring, the coating being applied to one or both of the circumferentially facing surfaces.

17. A tip treatment ring as claimed in claim 15, wherein the bars are manufactured as separate components which are subsequently assembled with the end supports to form the ring.

18. A tip treatment ring as claimed in claim 17, in which the coating is applied to the bars prior to assembly of the ring.

19. A tip treatment ring as claimed in claim 15, wherein the bars and the end supports are formed integrally.

* * * * *